US007530427B2

(12) United States Patent
Feist et al.

(10) Patent No.: US 7,530,427 B2
(45) Date of Patent: May 12, 2009

(54) EXHAUST DEFLECTOR FOR A MUFFLER

(75) Inventors: Jeffrey P. Feist, Pewaukee, WI (US); Elliot Matel, Milwaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 302 days.

(21) Appl. No.: 11/451,026

(22) Filed: Jun. 12, 2006

(65) Prior Publication Data

US 2007/0284187 A1 Dec. 13, 2007

(51) Int. Cl.

| | |
|---|---|
| ***F01N 1/24*** | (2006.01) |
| ***F01N 3/06*** | (2006.01) |
| *F01N 1/00* | (2006.01) |
| *F01N 3/02* | (2006.01) |

(52) U.S. Cl. ..... 181/256; 181/231

(58) Field of Classification Search ..... 181/256, 181/230, 231, 252

See application file for complete search history.

(56) References Cited

U.S. PATENT DOCUMENTS

| | | | | | |
|---|---|---|---|---|---|
| 3,115,209 | A | * | 12/1963 | Bembinster | 181/243 |
| 3,196,977 | A | * | 7/1965 | Sanders | 181/256 |
| 3,380,553 | A | * | 4/1968 | Gibel | 181/230 |
| 3,561,561 | A | * | 2/1971 | Trainor | 181/267 |
| 3,677,364 | A | * | 7/1972 | Pawlina | 181/269 |
| 3,688,868 | A | * | 9/1972 | Gibel et al. | 181/230 |
| 3,757,892 | A | * | 9/1973 | Raudman, Jr. | 181/256 |
| 3,838,977 | A | * | 10/1974 | Warren | 422/179 |
| 3,863,733 | A | * | 2/1975 | Raudman et al. | 181/252 |
| 3,880,245 | A | * | 4/1975 | Anderson, Jr. | 173/219 |
| 4,033,428 | A | * | 7/1977 | Wennerstrom | 181/230 |
| 4,045,157 | A | * | 8/1977 | Peterson | 431/114 |
| 4,113,051 | A | | 9/1978 | Moller | |
| 4,135,602 | A | * | 1/1979 | Clark | 181/230 |
| 4,205,732 | A | * | 6/1980 | Auerbach et al. | 181/230 |
| 4,219,100 | A | * | 8/1980 | Wyse | 181/230 |
| 4,286,976 | A | * | 9/1981 | Eriksson | 96/387 |
| 4,316,523 | A | * | 2/1982 | Boretti | 181/226 |
| 4,324,314 | A | * | 4/1982 | Beach et al. | 181/230 |
| 4,424,883 | A | * | 1/1984 | Musiani | 181/258 |
| 5,166,479 | A | * | 11/1992 | Gras et al. | 181/256 |
| 5,177,962 | A | * | 1/1993 | Hall et al. | 60/311 |
| 5,627,351 | A | | 5/1997 | Okuma et al. | |

(Continued)

FOREIGN PATENT DOCUMENTS

DE 3243631 A1 * 5/1984

(Continued)

OTHER PUBLICATIONS

Exhaust deflector with fiberglass made by Enerpower SRL of Monza, Italy, at least as early as Feb. 1, 2006.

*Primary Examiner*—Edgardo San Martin
(74) *Attorney, Agent, or Firm*—Michael Best & Friedrich, LLP

(57) ABSTRACT

An exhaust deflector is attachable to a muffler. The exhaust deflector includes a housing having a flange that is attachable to the muffler, and an outer wall extending from the flange. The outer wall defines an aperture. A single piece mesh is in contact with the flange and cooperates with the housing to define a space. A low-density material is disposed within the space.

30 Claims, 4 Drawing Sheets

U.S. PATENT DOCUMENTS 5,722,237 A * 3/1998 Iida et al. ..... 60/302
5,969,299 A 10/1999 Yamaguchi et al.
6,109,387 A 8/2000 Boretti
6,470,998 B1 10/2002 White
6,540,046 B1 * 4/2003 Schuhmacher et al. ..... 181/231
6,968,922 B2 11/2005 Kawamata et al.
7,185,678 B1 * 3/2007 Stell et al. ..... 138/41
2003/0136607 A1 7/2003 Kawamata et al.
2005/0150716 A1 7/2005 Nasuno et al.
2008/0099277 A1 * 5/2008 Liu et al. ..... 181/230

FOREIGN PATENT DOCUMENTS

EP 1160424 5/2001
GB 2056563 A * 3/1981

* cited by examiner

EXHAUST DEFLECTOR FOR A MUFFLER

BACKGROUND

The present invention relates to an exhaust deflector for a muffler. More particularly, the invention relates to an exhaust deflector for a small engine that reduces the engine noise.

Engines generally include a muffler that receives exhaust gas from the engine and redirects the flow of exhaust gas to reduce the noise of the engine. For example, many muffler designs include multiple passages and changes in flow direction that change the acoustic impedance (i.e., the velocity and/or the pressure) of the gas. Changes in the acoustic impedance are intended to create a mismatch that generally reduces the noise produced by the gas.

However, given the limited space on some small engines, it is possible that the space available for a muffler is not adequate to provide the level of noise attenuation desired.

SUMMARY

In one embodiment, the invention provides an exhaust deflector attachable to a muffler. The exhaust deflector includes a housing having a flange that is attachable to the muffler, and an outer wall extending from the flange. The outer wall defines an aperture. A single piece mesh is in contact with the flange and cooperates with the housing to define a space. A low-density material is disposed within the space.

In another embodiment, the invention provides a muffler for an internal combustion engine that discharges exhaust gas. The muffler includes an inlet in fluid communication with the engine to receive the flow of exhaust gas and a casing that defines a chamber in fluid communication with the inlet to receive the exhaust gas from the inlet. An outlet is adapted to direct the exhaust gas from the chamber. A housing includes a flange and a wall and defines an aperture spaced from the flange. The flange is connected to the outlet and a mesh is sandwiched between the flange and the outlet. The mesh cooperates with the housing to define a substantially enclosed annular space and a low-density material is disposed within the annular space.

In another embodiment, the invention provides an exhaust deflector for a muffler. The exhaust deflector includes a flange adapted to attach to the muffler and provide a substantially fluid tight seal therebetween. A first wall extends from the flange and a second wall extends from the first wall in a non-parallel direction. The second wall defines an aperture. A single piece mesh has a first portion that attaches to the flange and a second portion that cooperates with the first wall and the second wall to at least partially define a space. A low density material is disposed within the space.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
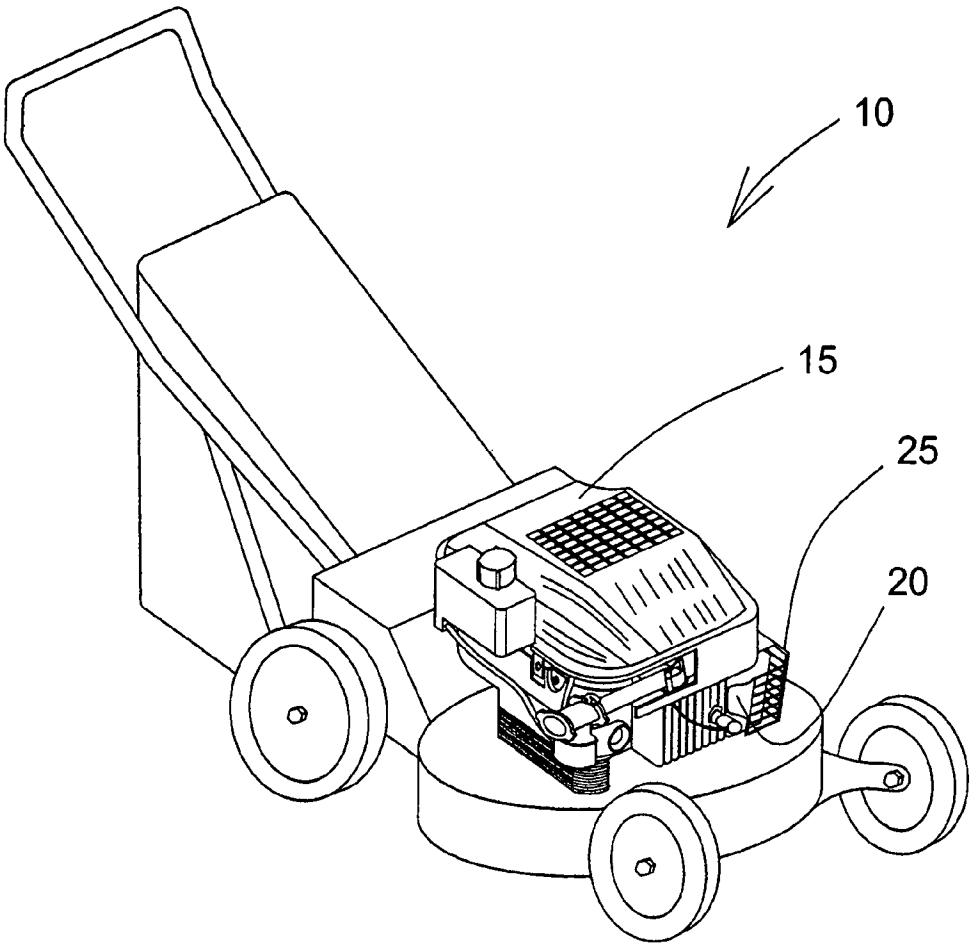
FIG. 1 is a perspective view of a lawn mower including an engine having a muffler.

FIG. 1 illustrates a lawn mower 10 that includes a small engine 15. The engine 15 includes a piston that reciprocates within a cylinder in response to combustion of an air-fuel mixture within a combustion chamber. The reciprocation of the piston produces a corresponding rotation of a crankshaft which in turn rotates a power take off to perform work.

Before proceeding, it should be noted that the term "small engine" as used herein generally refers to an internal combustion engine that includes one or two cylinders. The engine can be arranged with a horizontal or a vertical crankshaft as may be required. While the invention discussed herein is particularly suited for use with small engines, one of ordinary skill in the art will realize that it could be applied to larger engines (i.e., three or more cylinders) as well as other engine designs (e.g., rotary engine, radial engine, diesel engines, combustion turbines, and the like). In fact, the invention could be applied to virtually any flow stream in which a reduction in noise is desired. As such, the invention should not be limited to the small engine application described herein.

With continued reference to FIG. 1, the engine 15 includes a muffler 20 that receives a flow of exhaust gas from the cylinder, quiets the flow of exhaust gas, and discharges the exhaust gas to the atmosphere. In the illustrated construction, a guard 25 is positioned over the muffler 20 to reduce the likelihood of contact with the muffler 20 during engine operation.

Figure 2:
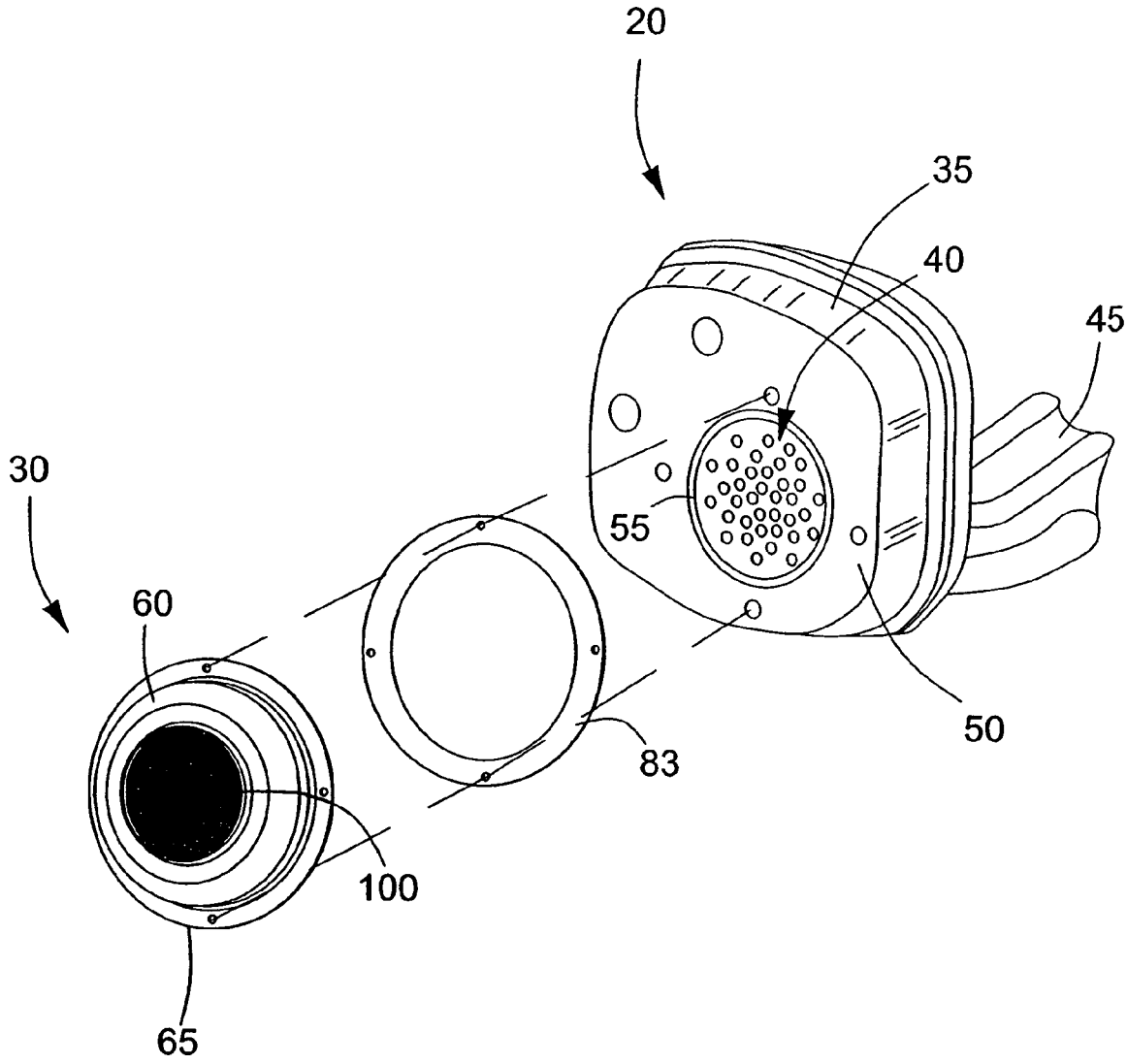
FIG. 2 is a perspective view of the muffler of FIG. 1 including an exhaust deflector.

FIG. 2 illustrates the muffler 20 of FIG. 1 including an exhaust deflector 30. The muffler 20 includes a housing 35 or casing that defines a muffler chamber, an outlet aperture 40, and an inlet 45 such as an inlet aperture or an inlet tube. The inlet 45 is in fluid communication with the cylinder or cylinders to receive the flow of exhaust gas and direct that flow to the muffler chamber. The muffler chamber includes one or more passages (not shown) that redirect the flow to change the acoustic impedance and the noise produced by the engine 15.

The housing 35 defines a surface 50 having the outlet aperture 40. The surface 50 has a muffler flange 55 that receives the exhaust deflector 30 such that the outlet aperture 40 is in fluid communication with the exhaust deflector 30.

It should be noted that FIG. 2 illustrates one possible muffler 20 suited for use with the exhaust deflector 30. In the illustrated construction, the muffler housing 35 defines the muffler flange 55 to which the exhaust deflector 30 attaches. In other constructions, a tube or exhaust pipe may extend from the housing 35 and receive the exhaust deflector 30. In addition, other inlet arrangements, muffler chamber arrangements, and housing arrangements are also possible and will not affect the function of the exhaust deflector 30.

FIGS. 3-6 illustrate the exhaust deflector 30 of FIG. 2 in greater detail. The exhaust deflector 30 includes a housing 60 (shown in FIG. 4) having a flange 65, a first wall 70, a second wall 75, and a collar 80. The flange 65 has an annular surface that engages the muffler flange 55 to define a substantially fluid tight seal therebetween. In preferred constructions, the flange 65 and the muffler flange 55 are planar to enhance the seal. Of course, non-planar arrangements are also possible. In some constructions a gasket, o-ring, or other sealing member 83 is positioned between the muffler flange 55 and the exhaust deflector flange 65 to enhance the seal between the two components. The flange 65 also includes a plurality of apertures 85 spaced around the flange 65 to receive fasteners. The fasteners pass through the flange 65 to attach the exhaust deflector 30 to the muffler 20.

The first wall 70 is a substantially cylindrical wall that extends a first non-zero distance 90 from the flange 65. In the illustrated construction, the first wall 70 is normal to the flange 65. However, other constructions may employ a different angle between the flange 65 and the first wall 70 as required for the particular application. In addition, while a cylindrical wall having a circular cross section has been illustrated, other constructions may employ other shapes. For example, an oval or elliptical cross section could be employed. In addition, polygonal cross section walls, or irregular shaped walls could also be employed if desired.

The second wall 75 extends from the first wall 70 and defines an outlet aperture 95. As illustrated, the second wall 75 is substantially normal to the first wall 70, and thus substantially parallel to the flange 65. In the illustrated construction, the second wall 75 defines a substantially planar surface, with other constructions employing non-planar second walls 75. The outlet aperture 95 includes a large opening approximately centered in the second wall 75. Of course, other constructions may employ multiple smaller apertures that cooperate to define the outlet aperture 95 and may include a second wall 75 that is not substantially normal to the first wall 70.

Figure 3:
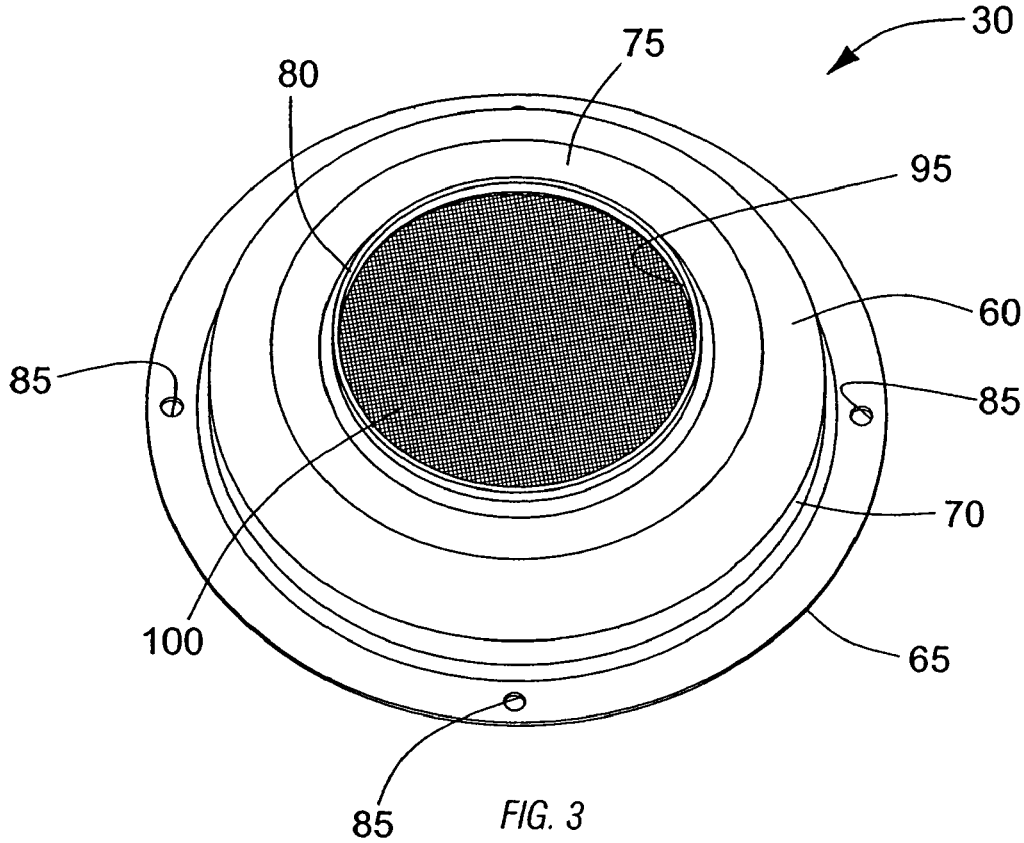
FIG. 3 is a front perspective view of the exhaust deflector of FIG. 2.
Figure 4:
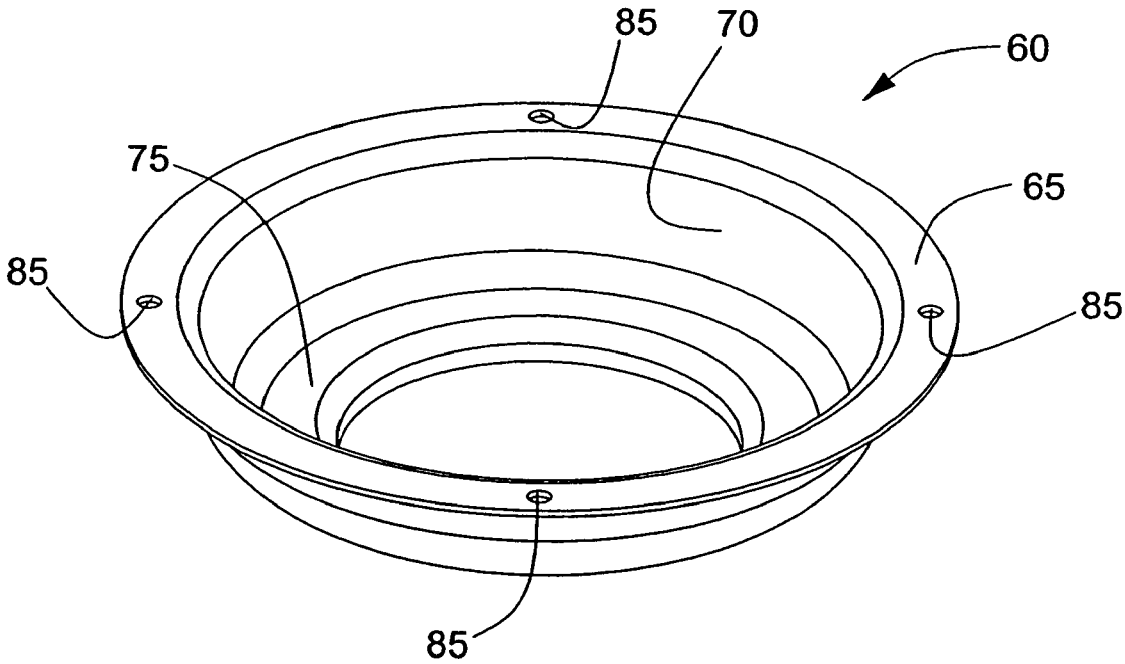
FIG. 4 is a rear perspective view of a housing of the exhaust deflector of FIG. 2.

The collar 80, shown in FIG. 3, encircles the outlet aperture 95 and extends from the second wall 75. The collar 80 is substantially normal to the second wall 75 and thus substantially parallel to the first wall 70. In some constructions, the collar 80 may be omitted or arranged at an angle other than one that is substantially normal to the second wall 75.

In preferred constructions, the housing 60—including the flange 65, the first wall 70, the second wall 75, and the collar 80—is integrally-formed as a single piece. For example, in one construction, the housing 60 is formed by stamping, drawing or otherwise forming a metal sheet. In other constructions, the housing 60 is cast or otherwise formed. In still other constructions, multiple separate pieces are attached to one another (e.g., welded, soldered, brazed, and the like) to complete the housing 60.

Figures 5, 6:
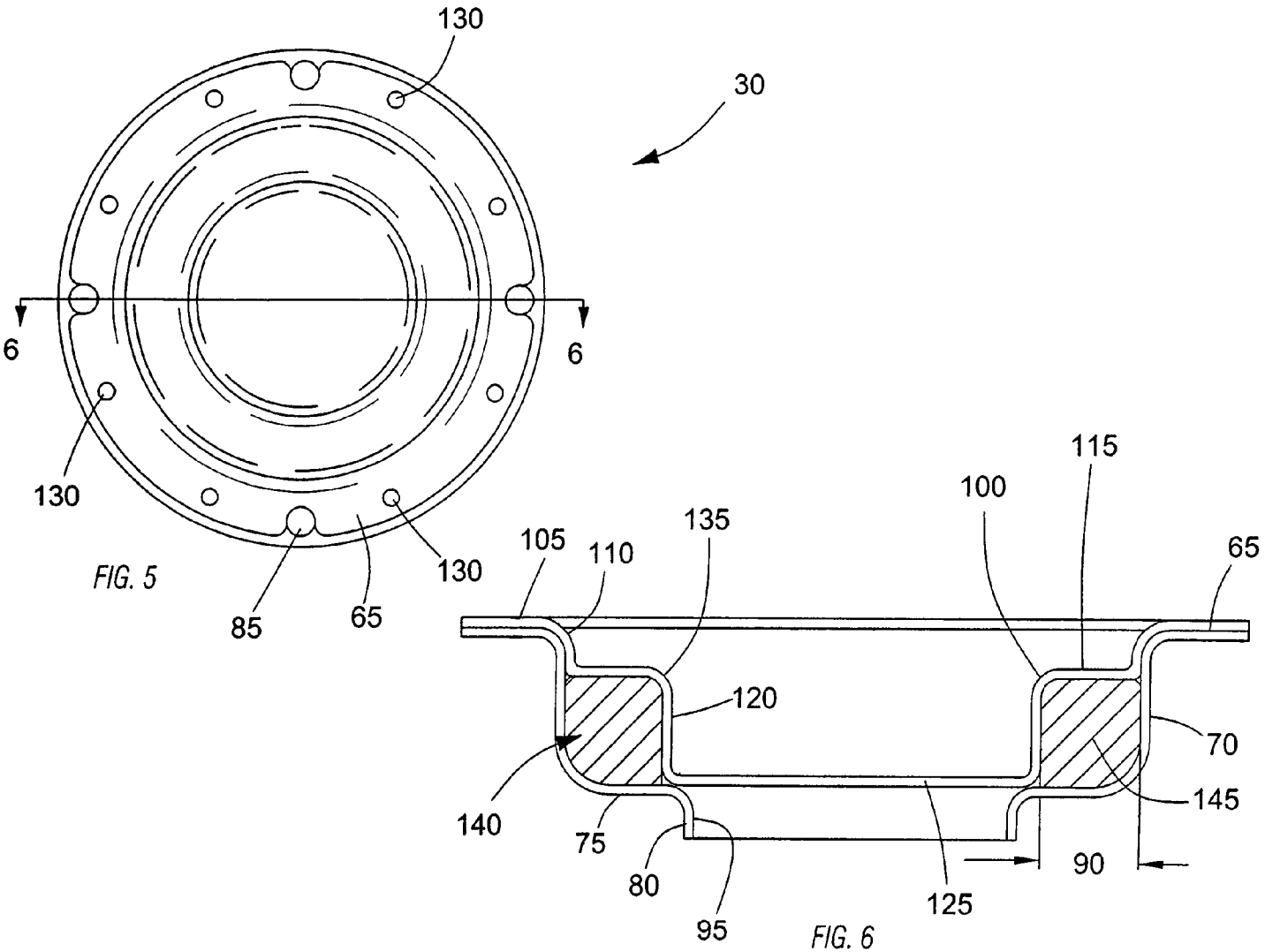
FIG. 5 is a rear view of the exhaust deflector of FIG. 2.
FIG. 6 is a section view of the exhaust deflector of FIG. 2, taken along line 6-6 of FIG. 5.

As illustrated in FIGS. 3, 5, and 6, the exhaust deflector 30 also includes a mesh 100 that attaches to the housing 60 and covers the outlet aperture 95. As illustrated in FIGS. 5 and 6, the mesh 100 attaches to the flange 65 and is contoured to define a flange portion 105, a first mesh wall 110, a second mesh wall 115, a third mesh wall 120, and an aperture-covering portion 125. The flange portion 105 is arranged to be parallel to the flange 65 to facilitate attachment of the mesh 100 to the flange 65. As illustrated in FIG. 5, a plurality of welds 130 can be employed to attach the mesh 100, with other attachment methods (e.g., fasteners, adhesives, clamps, soldering, brazing, and the like) also being suitable for use.

Turning to FIG. 6, the first mesh wall 110 extends from the flange portion 105 such that it is parallel to and adjacent the housing first wall 70. However, the first mesh wall 110 extends along only a portion of the length of the first wall 70.

The second mesh wall 115 extends from the first mesh wall 110 and is substantially parallel to the flange 65. The second mesh wall 115 extends inward from the first mesh wall 110 to define an annular surface that includes an aperture 135 that is slightly larger than the outlet aperture 95. Of course many variations of this arrangement are possible. For example, the aperture 135 could be larger or smaller than that illustrated. In addition, the second mesh wall 115 could be arranged with respect to the first mesh wall 110 to define a non-normal angle.

The third mesh wall 120 extends from the second mesh wall 115 to the housing second wall 75. In the illustrated construction, the third mesh wall 120 is substantially parallel to the housing first wall 70 and is spaced apart from the housing first wall 70. Again, other arrangements and angles of the third mesh wall 120 are possible.

The third mesh wall 120 is substantially cylindrical and extends from the second mesh wall 115 to the outlet aperture 95. The aperture-covering portion 125 extends across the circular opening defined by the third mesh wall 120 adjacent the outlet aperture 95 to cover the aperture 95.

In preferred constructions, a single piece of mesh material 100 is used. Again, the mesh material 100 could be formed using a number of manufacturing techniques including stamping, drawing, progressive dies, and the like. Generally, a mesh 100 having a plurality of openings with an average opening area of 1 square millimeter per opening is preferred. However, meshes including larger average opening areas or smaller average opening areas are also possible.

With reference to FIG. 6, the mesh 100 and the housing 60 cooperate to define a space 140. More particularly, the second mesh wall 115 and the third mesh wall 120 cooperate with the first wall 70 and the second wall 75 of the housing 60 to define the space 140. The space 140 is substantially annular and has a substantially rectangular cross section. In most constructions, a low-density material 145 such as fiberglass is positioned within the space 140 to attenuate noise. Of course, low-density material 145 other than fiberglass could be employed so long as the material 145 is suited to exposure to high temperature fluids or the particular fluids that pass through the exhaust deflector 30.

During engine operation, hot exhaust gas passes from the cylinder to the muffler inlet 45, through the muffler chamber, to the outlet 40. The muffler chamber reduces the magnitude of the noise produced by the engine 15. From the muffler outlet 40, the air enters the exhaust deflector 30. As the exhaust gas passes through the exhaust deflector 30, the gas substantially flows past the low-density material 145 and through the mesh 100 to the outlet aperture 95. Sound pressure waves are dissipated as they freely pass though the mesh 100 into the low-density material 145. Additionally, the reactive properties of the mesh 100 and the housing 60 contribute to noise reduction. Thus, the exhaust deflector 30 changes the acoustic impedance and further reduces the noise produced by the engine 15.

The arrangement of the mesh 100 is such that any forces produced by the flow of exhaust gas through the exhaust deflector 30 tend to hold the mesh 100 in the desired position. As such, additional support for the mesh 100, or attachment points for the mesh 100 are generally unnecessary.

Thus, the invention provides, among other things, a new and useful exhaust deflector 30 for a muffler 20. More specifically, the invention provides an exhaust deflector 30 that further reduces the noise produced by an internal combustion engine 15.

What is claimed is:

1. An exhaust deflector attachable to a muffler, the exhaust deflector consisting essentially of:

a housing having a flange that is attachable to the muffler and an outer wall extending from the flange, the outer wall defining an inlet aperture and a single outlet aperture;

a single piece mesh in contact with the flange and cooperating with the housing to define a space; and a low-density material disposed within the space and at least partially supported by the single piece mesh.

2. The exhaust deflector of claim 1, wherein the space is substantially annular.

3. The exhaust deflector of claim 1, wherein the mesh includes a plurality of openings, and wherein the average size of the openings is less than about 1 square millimeter.

4. The exhaust deflector of claim 1, wherein a portion of the mesh is sandwiched between the flange and the muffler.

5. The exhaust deflector of claim 1, wherein the mesh is welded to the flange.

6. The exhaust deflector of claim 1, wherein the low density material includes fiberglass.

7. The exhaust deflector of claim 1, wherein the mesh includes a portion that is adjacent to and covers the aperture.

8. A muffler for an internal combustion engine that discharges exhaust gas, the muffler comprising:

an inlet in fluid communication with the engine to receive the flow of exhaust gas;

a casing defining a chamber in fluid communication with the inlet to receive the exhaust gas from the inlet;

an outlet adapted to direct the exhaust gas from the chamber;

a housing including a flange that defines a single inlet aperture and a wall defining a single outlet aperture spaced from the flange, the flange connected to the outlet, the inlet aperture and the outlet aperture being positioned coaxially;

a mesh sandwiched between the flange and the outlet, the mesh cooperating with the housing to define a substantially enclosed annular space; and a low-density material disposed within the annular space.

9. The muffler of claim 8, further comprising a gasket disposed between the muffler and the flange.

10. The muffler of claim 8, wherein the mesh includes a plurality of openings, and wherein the average size of the openings is less than 1 square millimeter.

11. The muffler of claim 8, wherein a portion of the mesh is fixedly attached to the flange.

12. The muffler of claim 11, wherein the mesh is welded to the flange.

13. The muffler of claim 8, wherein the low density material includes fiberglass.

14. The muffler of claim 8, wherein the outlet includes a pipe extending from the casing.

15. The muffler of claim 8, wherein the mesh includes a portion adjacent to and covering the first aperture.

16. An exhaust deflector for a muffler, the exhaust deflector comprising:

a flange adapted to attach to the muffler and provide a substantially fluid tight seal therebetween;

a first wall extending from the flange and defining a single inlet aperture;

a second wall extending from the first wall in a non-parallel direction;

a collar extending from the second wall in a non-parallel direction, the collar defining a single outlet aperture;

a single piece mesh having a first portion that attaches to the flange and a second portion including a first mesh wall and a second mesh wall non-parallel with respect to the first mesh wall, wherein the first mesh wall and the second mesh wall cooperate with the first wall and the second wall to at least partially define a space; and a low density material disposed within the space.

17. The exhaust deflector of claim 16, wherein the space is substantially annular.

18. The exhaust deflector of claim 16, wherein the mesh includes a plurality of openings, and wherein the average size of the openings is less than 1 square millimeter.

19. The exhaust deflector of claim 16, wherein a portion of the mesh is sandwiched between the flange and the muffler.

20. The exhaust deflector of claim 16, wherein the mesh is welded to the flange.

21. The exhaust deflector of claim 16, wherein the low density material includes fiberglass.

22. The exhaust deflector of claim 16, wherein the flange the first wall, the second wall, and the collar are integrally-formed as a single piece.

23. The exhaust deflector of claim 16, wherein the collar extends normal to the second wall.

24. The exhaust deflector of claim 16, wherein, a third portion of the single-piece mesh is disposed adjacent the outlet aperture such that the third portion covers the outlet aperture.

25. The exhaust deflector of claim 1, wherein the low-density material is positioned between the single piece mesh and the housing.

26. The exhaust deflector of claim 1, wherein the single piece mesh and the housing cooperate to substantially enclose the space.

27. The exhaust deflector of claim 1, wherein the flange defines an upstream side and the outlet aperture defines a downstream side, and wherein the low-density material is positioned on the downstream side with respect to the single piece mesh.

28. The exhaust deflector of claim 1, wherein the outlet aperture provides an exit for exhaust gases, and wherein the single piece mesh covers the outlet aperture.

29. The exhaust deflector of claim 16, wherein the first mesh wall is substantially parallel to the second wall.

30. The exhaust deflector of claim 16, wherein the second mesh wall is substantially parallel to the first wall.

* * * * *